US005218821A

United States Patent [19]

Beneteau

[11] Patent Number: 5,218,821

[45] Date of Patent: Jun. 15, 1993

[54] PRESSURE INTENSIFIER CYLINDER UTILIZING AIR

[75] Inventor: Donald J. Beneteau, Amherstburg, Canada

[73] Assignee: Doben Limited, Windsor, Canada

[21] Appl. No.: 872,349

[22] Filed: Apr. 23, 1992

[51] Int. Cl.[5] ..... F15B 7/00

[52] U.S. Cl. ..... 60/560; 60/570; 60/581; 60/593; 92/28; 91/519

[58] Field of Search ..... 60/560, 568, 570, 565, 60/581, 593; 92/22, 28; 91/29, 519

[56] References Cited

U.S. PATENT DOCUMENTS

| | | | |
|---|---|---|---|
| 2,169,423 | 8/1939 | Kessler et al. | 60/560 X |
| 2,378,103 | 6/1945 | Rappl | 60/568 X |
| 3,511,048 | 5/1970 | Nemetz | 60/560 X |
| 3,875,365 | 4/1975 | Beneteau | 60/560 X |
| 4,072,013 | 2/1978 | Bargareschi | 60/560 X |
| 4,099,436 | 7/1978 | Beneteau | 60/560 X |
| 4,499,728 | 2/1985 | Therond | 60/570 |

*Primary Examiner*—Edward K. Look
*Assistant Examiner*—Todd Mattingly
*Attorney, Agent, or Firm*—Allen D. Gutchess, Jr.

[57] ABSTRACT

A pressure intensifier drive unit has walls that form a cylinder with an intermediate divider plug separating a working chamber and a pressure intensifying chamber aligned in the cylinder. The working chamber has a working piston and a working piston rod extending from an end of the cylinder. A carrier piston is located between the working piston and the divider plug and has a cylindrical recess receiving the working piston, a hydraulic fluid chamber, and a bore. A locking piston is movably mounted on the carrier piston and locks the carrier piston in place when the working piston rod initially contacts a workpiece. A pressure intensifier piston in the pressure intensifying chamber has a pressure intensifier piston rod extending through a bore in the divider plug and through the bore in the carrier piston into the hydraulic fluid chamber. With the carrier piston locked and the pressure intensifier piston rod moving into the hydraulic fluid chamber, the working piston and working piston rod are moved more slowly and under higher pressure against the workpiece. Gas, preferably air, is used to power all three pistons in the working chamber and the pressure intensifier piston in the pressure intensifying chamber. The pistons are also returned to their initial positions by air. Hence, air under pressure is the only external fluid required for operating the drive unit.

15 Claims, 1 Drawing Sheet

PRESSURE INTENSIFIER CYLINDER UTILIZING AIR

Figure 1:
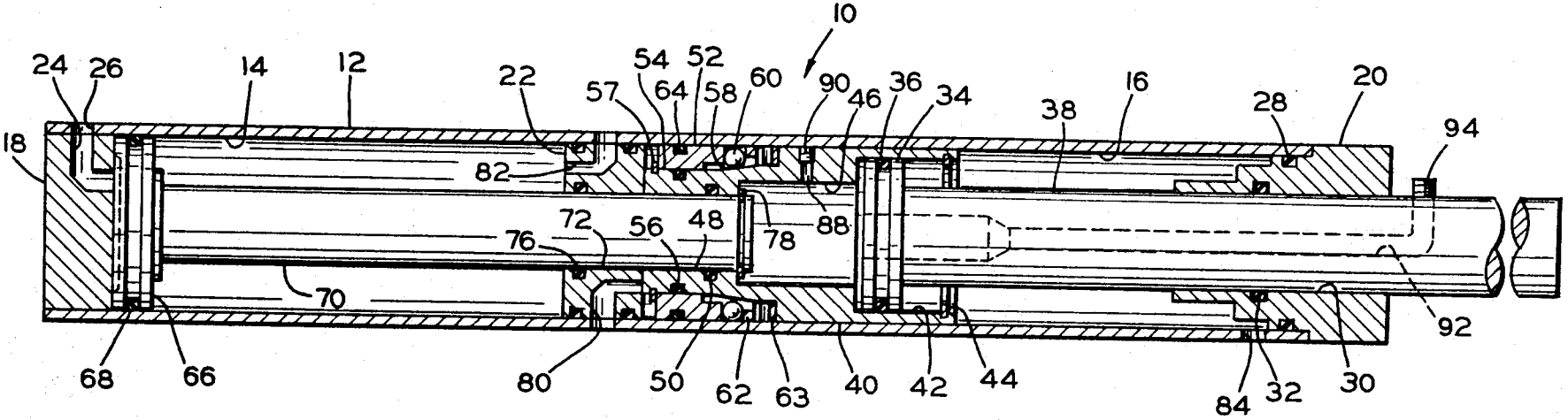

This invention relates to a pressure intensifier drive unit with an internal hydraulic fluid chamber.

Pressure intensifier drive units are known in the art and are commonly used for resistance welding, piercing, and coining by way of example. Such a drive unit is basically represented in my U.S. Pat. No. 3,875,365. The unit includes a cylinder which is divided by a plug or block into two chambers, a working chamber and a pressure intensifying chamber. One contains a working piston and a working piston rod extending from an end of the cylinder. The other chamber contains a pressure intensifier piston and a pressure intensifier piston rod extending toward the first chamber. Heretofore, hydraulic fluid such as oil from an external reservoir was supplied to a small chamber between the pressure intensifier piston rod and the working piston. This oil forced the working piston rod further out of the cylinder and toward and against a workpiece under relatively high speed and low pressure. Air was supplied to the top of the pressure intensifier piston which moved its piston rod down through the small oil chamber, closing it off. Further movement of the pressure intensifier piston rod then moved the working piston rod at a slower speed and higher pressure against the workpiece with minimal mechanical shock.

The external oil reservoir heretofore employed required additional space and added to the cost of the overall unit. The external oil line also presented a possibility for leaks and a possible hazard.

The pressure intensifier unit according to the invention has a movable piston in the working chamber which receives the working piston and an end of the pressure intensifier piston rod, with an internal hydraulic fluid chamber formed therebetween. The movable piston also carries a locking piston therearound at one end portion. The locking piston carries camming elements which move against the inner surface of the cylinder when the working piston rod engages the workpiece and air pressure continues to move the locking piston to engage the camming elements with the interior surface of the cylinder. This locks the movable piston in place so that further movement of the pressure intensifier piston moves its piston rod into the hydraulic fluid chamber and moves the working piston more slowly and at a much higher pressure, as before. Air passages are employed to return the respective pistons to their initial positions when the particular operation is complete.

It is, therefore, a principal object of the invention to provide a pressure intensifier drive unit with an enclosed, internal hydraulic fluid chamber.

Another object of the invention is to provide a pressure intensifier unit with an intermediate movable piston having a hydraulic fluid chamber and a locking piston to lock the movable piston in place.

Figure 2:
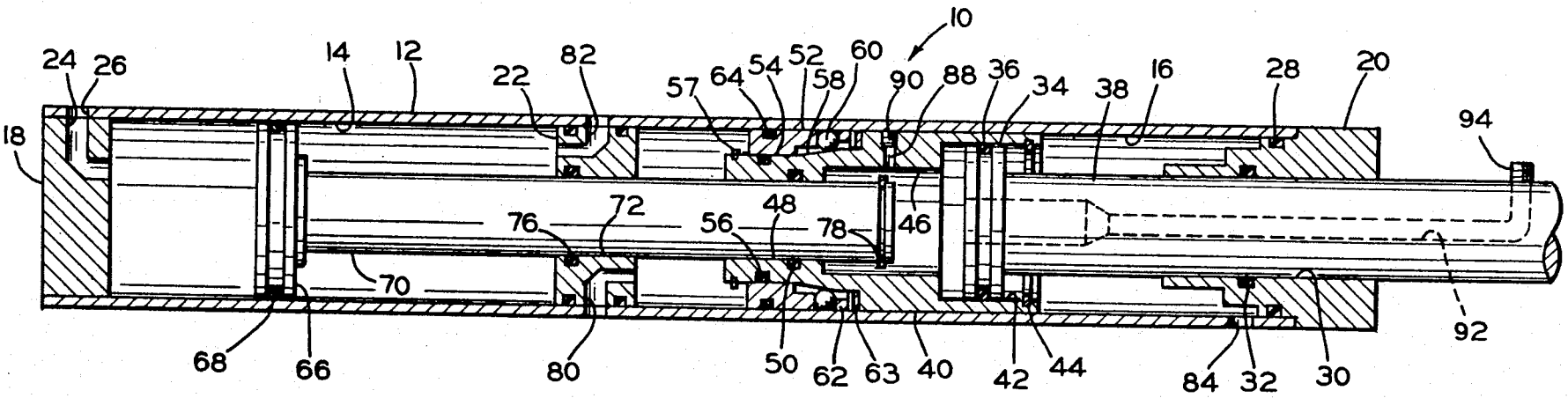

Many other objects and advantages of the invention will be apparent from the following detailed description of a preferred embodiment thereof, reference being made to the accompanying drawings, in which:

FIG. 1 is a somewhat schematic view in longitudinal cross section of a pressure intensifier drive unit in accordance with the invention; and FIG. 2 is a view similar to FIG. 1 with certain components shown in different positions.

A pressure intensifier drive unit in accordance with the invention is indicated at 10 and includes wall means forming a cylinder 12 which has a first or pressure intensifying cylindrical chamber 14 and a second or working cylindrical chamber 16. The first end of the cylinder 12 has a first end plug or block 18 closing off an end of the chamber 14. The other end of the cylinder 12 has a second end plug or block 20 closing off the end of the chamber 16. An intermediate fixed plug or block 22 constitutes a divider or partition separating the chambers 14 and 16. The end plug 18 has an L-shaped passage 24 therein which communicates with an opening 26 in the chamber 14 for the passage of gas under pressure, preferably air. The end plug 20 has an annular seal 28 contacting the lower end of the cylinder 12 and has a central bore 30 with an inner annular seal 32.

A working piston 34 with an annular seal 36 is located within the second chamber 16 and has a piston rod 38 affixed thereto and extending through the bore 30 in the end plug 20. The outer end of the piston rod can have suitable means for making a connection with an electrode (not shown) when employed for resistance welding or can have other means for making it adaptable to other operations, such as piercing, riveting, clenching, and forming. The piston rod 38 can be of noncircular shape and cooperate with suitable means at the end of the plug 20 to prevent rotation of the rod, if desired, as is disclosed in my U.S. Pat. No. 4,099,436, for example.

A movable carrier piston 40 in accordance with the invention is located toward the intermediate plug 22 in the chamber 16. The piston 40 has an end cylindrical recess 42 which receives the piston 34 of the working piston rod 38. A locking ring 44 at the open end of the cylindrical recess 42 limits movement of the piston 34 toward the plug 20 at the end of the cylinder 12. The carrier piston 40 is slidably located in the chamber 16 but without any seals between it and the cylinder 12. The piston 40 also has an internal hydraulic fluid or oil chamber 46 beyond the cylindrical recess 42 and a smaller, central bore 48 therebeyond with an annular seal 50 therein near the oil chamber 46.

The carrier piston 40 also has an annular locking piston 52 carried on a neck or extension 54 thereof with an annular seal 56 therebetween. Movement of the annular piston 52 is limited by a locking ring 57 in one direction. In the opposite direction, the neck 54 of the piston 40 has a slanted, annular ramp 58. The locking piston 52 has camming elements in the form of rollers or balls 60 uniformly spaced around the cylinder by holes or fingers 62. When the locking piston 52 moves toward the carrier piston 40, the balls 60 ride up the annular ramp 58 and engage the inner surface of the cylinder 12 to stop longitudinal movement of the piston 40 and the locking piston 52. A wave spring washer 63 can be employed in front of the fingers 62 to assist in moving back the locking piston 52.

The camming elements 60 are preferably in the form of rollers of barrel-shaped configuration. The outer surfaces of the rollers are curved with radii substantially equalling the radius of the inner surface of the cylinder 12. This provides maximum contact between the elements and the surface. The number of camming elements will depend upon the particular size of pressure intensifier drive unit 10. With a two-inch cylinder, for example, eight to twelve of the camming elements will be employed around the carrier piston.

The piston 52 has an annular seal 64 with respect to the cylinder 12 so that pressure to the left of the pistons 40 and 52 moves them toward the right until the piston rod 38 engages a workpiece and also is against the bottom end of the cylindrical recess 42. This causes the carrier piston 40 to stop but the locking piston 52 will continue as long as pressure exists to the left thereof. This causes the locking piston 52 to move toward the position of FIG. 2 and causes the balls or rollers 60 to move outwardly by the action of the annular ramp 58. The balls or rollers 60 then engage the inner surface of the cylinder 12 to prevent any movement of both of the pistons 40 and 52 relative to the cylinder 12.

A pressure intensifier piston 66 with an annular seal 68 is located in the chamber 14 and has a pressure intensifier piston rod 70 extending therefrom and through a bore 72 with an annular seal 76 in the divider plug 22. The piston rod 70 also extends through the bore 48 with the seal 50 in the carrier piston 40 and into the enclosed hydraulic fluid chamber 46. A locking ring 78 limits rearward movement of the piston rod 70 relative to the carrier piston 40.

When the working piston rod 38 engages an object and stops, and the piston 34 abuts the rear of the chamber 42 so that the piston 40 stops, air pressure in the chamber 16 will still move the locking piston 52 relative to the piston 40 until the elements 60 engage the cylinder 12. The air under pressure applied to the carrier piston 40 and the locking piston 52 is supplied through an inlet port 80 in the divider plug 22. Air under pressure also is supplied through the passage 24 and acts on the pressure intensifier piston 66, moving the piston rod 70 into the fluid chamber 46. This causes an increase in pressure on the liquid and forces the piston 34 forwardly to intensify the force on the working piston rod 38. Pressure multiplication can thus be obtained, basically similar to that set forth in my U.S. Pat. No. 3,875,365, without the need for a separate liquid or oil reservoir.

When the operation is completed, return air or other gas can be supplied through a passage 82 in the divider plug 22 and air can also be supplied through a port 84 at the lower end of the cylinder 12. This air under pressure returns the piston 66 to its original position of FIG. 1 and moves the piston 34 back to the end of the cylindrical recess 42 in the carrier piston 40. The air also acts upon the locking piston 52 to move it toward the left and release the elements 60. This air acts on the piston 52 since the carrier piston 40 is not sealed relative to the cylinder, whereby the air under pressure can move around it and act on the piston 52. Thus, both of the pistons 40 and 52 move back to their original position against the divider plug 22 with the locking piston 52 contacting the locking ring 57. Control of the air can be through a four-way valve or other suitable means. In some instrances, it is desirable to control the return air separately.

Before the drive unit 10 is originally assembled, the hydraulic fluid or oil can be supplied to the chamber 46 through a recessed bore 88 having a plug 90. For subsequent replenishment, the oil can be supplied through the piston rod 38 having an L-shaped passage 92 therein communicating with the chamber 46 through the piston 34 and having a suitable plug 94 in a side of the piston rod.

Various modifications of the above-described embodiment of the invention will be apparent to those skilled in the art, and it is to be understood that such modifications can be made without departing from the scope of the invention, if they are within the spirit and the tenor of the accompanying claims.

I claim:

1. A pressure intensifier drive unit comprising wall means forming a cylinder, first plug means closing off one end of said cylinder, second plug means closing off the other end of said cylinder, intermediate divider plug means separating the interior of said cylinder into a pressure intensifying cylindrical chamber at said one end of said cylinder and a working chamber at said other end of said cylinder, said first plug means having passage means for supplying fluid into said pressure intensifying chamber, said second plug means having a central bore therethrough, a working piston in said working chamber and having a working piston rod affixed thereto and extending through said bore, a carrier piston located in said working chamber, said carrier piston having a cylindrical recess in which said working piston is received, said carrier piston having a hydraulic fluid chamber behind said cylindrical recess, said carrier piston also having a bore at the end of said hydraulic fluid chamber opposite said cylindrical recess, said carrier piston further having a neck around an end portion thereof opposite said cylindrical recess, the end of said neck toward said cylindrical recess having an annular ramp, an annular locking piston located around said neck and slidably movable thereon, said locking piston carrying a plurality of camming elements at an end toward said annular ramp, said divider plug means having a central bore, said divider plug means having a first fluid passage communicating with the outside of said cylinder and with said working chamber behind said carrier piston, a pressure intensifier piston in said pressure intensifying chamber and having a pressure intensifier piston rod extending through said bore in said divider plug means and through said bore of said carrier piston and into said hydraulic fluid chamber, whereby when air under pressure is applied through said first passage of said divider plug means, said working piston, said carrier piston, and said locking piston move together until said working piston rod engages a workpiece or the like, said locking piston then forces the camming elements against the interior wall of said cylinder to lock said carrier piston in place, and whereby when air under pressure is supplied through said first plug to the end of said pressure intensifying chamber, said pressure intensifier piston and said pressure intensifier piston rod move toward said working piston to move said pressure intensifier piston rod into said hydraulic fluid chamber to move said working piston and said working piston rod further against the workpiece or the like under higher pressure and lower speed.

2. A pressure intensifier drive unit according to claim 1 wherein return air means are located in said divider plug means for returning said pressure intensifier cylinder to its initial position, adjacent said first plug means, and return air means communicate with said working chamber near said second plug means for returning said working piston, said carrier piston, and said locking piston to their initial positions adjacent said divider plug means.

3. A pressure intensifier drive unit according to claim 1 wherein said camming elements are balls.

4. A pressure intensifier drive unit according to claim 1 wherein said camming elements are barrel-shaped rollers.

5. A pressure intensifier drive unit comprising wall means forming a cylinder, first plug means closing off one end of said cylinder, second plug means closing off the other end of said cylinder, intermediate divider plug means separating the interior of said cylinder into a pressure intensifying cylindrical chamber at said one end of said cylinder and a working cylindrical chamber at said other end of said cylinder, first passage means for supplying air under pressure to said pressure intensifying chamber near said one end of said cylinder, said second plug means having a central bore therethrough, a working piston in said working chamber and having a working piston rod affixed thereto and extending through said bore and out of said other end of said cylinder, a carrier piston located in said working chamber between said working piston and said divider plug means, said carrier piston having a hydraulic fluid chamber with one end closed off by said working piston, said carrier piston also having a bore at the end of said hydraulic fluid chamber opposite said working piston, said carrier piston having an annular ramp on the outer surface thereof, an annular locking piston located around a portion of said carrier piston and movable therealong, said locking piston carrying a plurality of camming elements at an end toward said annular ramp, said divider plug means having a central bore, second passage means for supplying air under pressure to said working chamber behind said carrier piston and said locking piston, a pressure intensifier piston in said pressure intensifying chamber and having a pressure intensifier piston rod extending through said bore in said divider plug means and through said bore of said carrier piston and into said hydraulic fluid chamber, whereby when air under pressure is applied through said second passage means, said locking piston, said carrier piston, and said working piston move together until said working piston rod engages a workpiece or the like, said locking piston then moving further to force said camming elements up said annular ramp and against the interior wall of said cylinder to lock said carrier piston in place, and whereby when air under pressure is supplied to the end of said pressure intensifying chamber through said first passage means, said pressure intensifier piston and said pressure intensifier piston rod move toward said working piston to move said pressure intensifier piston rod further into said hydraulic fluid chamber to move said working piston and said working piston rod further against the workpiece or the like.

6. A pressure intensifier drive unit according to claim 5 wherein return air means are positioned to supply return air to said pressure intensifying chamber to return said pressure intensifier piston to its original position near said first plug means, and additional air supply means are positioned to supply return air to said working chamber near said second plug means.

7. A pressure intensifier drive unit according to claim 5 wherein said camming elements are balls.

8. A pressure intensifier drive unit according to claim 5 wherein said camming elements are barrel-shaped rollers.

9. A pressure intensifier drive unit according to claim 5 wherein said carrier piston has a cylindrical recess in which said working piston is received.

10. A pressure intensifier drive unit comprising wall means forming a pressure intensifying chamber and a working chamber aligned therewith, divider plug means separating said chambers, a working piston in said working chamber and having a working piston rod affixed thereto and extending out an end of said working chamber, a carrier piston located in said working chamber, said carrier piston having a hydraulic fluid chamber and also having a bore at an end toward said divider plug means, locking means carried by said carrier piston and having engaging means engaging said wall means for preventing movement of said locking means and said carrier piston when said working piston rod engages a workpiece or the like, said divider plug means having a central bore, first means for supplying air to said working chamber behind said carrier piston and said locking means, second means for supplying air under pressure to an end of said pressure intensifying chamber opposite said working chamber, a pressure intensifier piston in said pressure intensifying chamber and having a pressure intensifier piston rod extending through said bore in said divider plug means, whereby when air under pressure is supplied to said first means, said pressure intensifier piston rod moves into said hydraulic fluid chamber to move said working piston and said working piston rod further toward the workpiece or the like under higher pressure.

11. A pressure intensifier drive unit according to claim 10 wherein return air passage means are positioned to supply return air to said pressure intensifying chamber to move said pressure intensifier piston back toward its initial position, and additional return air passage means are positioned to supply return air to said working chamber to move said working piston, said carrier piston, and said locking means back toward their initial positions near said divider plug means.

12. A pressure intensifier drive unit according to claim 10 wherein said locking means comprises an annular piston.

13. A pressure intensifier drive unit according to claim 12 wherein said engaging means are a plurality of camming elements.

14. A pressure intensifier drive unit according to claim 13 wherein said carrier piston has an annular ramp moving said camming elements toward said wall means when said annular piston moves toward said annular ramp.

15. A pressure intensifier drive unit according to claim 10 wherein said carrier piston has a cylindrical recess communicating with said hydraulic fluid chamber, said working piston being received in said cylindrical recess.

* * * * *